US005809677A

United States Patent [19]

Wamser et al.

[11] Patent Number: 5,809,677

[45] Date of Patent: Sep. 22, 1998

[54] SIGNS AND DISPLAYS HAVING EASILY INTERCHANGEABLE INFORMATION PANELS

[75] Inventors: Carl H. Wamser, Greendale; Robert A. Karsten, Fox Point, both of Wis.

[73] Assignee: Everbrite, Inc., Greenfield, Wis.

[21] Appl. No.: 571,524

[22] Filed: Dec. 13, 1995

[51] Int. Cl.[6] ..... G09F 11/18

[52] U.S. Cl. ..... 40/471; 40/518

[58] Field of Search ..... 40/471, 483, 518–523; 24/576, 399

[56] References Cited

U.S. PATENT DOCUMENTS

| | | | |
|---|---|---|---|
| 2,756,172 | 7/1956 | Kidd | 24/399 X |
| 2,800,733 | 7/1957 | Chevillon | 40/471 |
| 3,255,977 | 6/1966 | Halco | 40/514 X |
| 3,616,554 | 11/1971 | Singer et al. | 40/471 |
| 3,726,031 | 4/1973 | Singer | 40/471 |
| 5,379,461 | 1/1995 | Wilmers | 2/115 |

*Primary Examiner*—Cassandra Davis
*Attorney, Agent, or Firm*—Ryan, Maki, Mann & Hohenfeldt

[57] ABSTRACT

A sign wherein individual film panels bearing graphical information are interconnected as an uninterrupted web by way of interconnecting plastic zippers. The web, which is composed of a series of film panel transparencies, is wound and unwound from spaced apart rollers for presenting the individual panels for viewing through a window in a housing. The concept of releasably interconnecting film panels is also used in stationary signs such as menu boards in fast food restaurants to provide for easy interchange of the panels when it is desired to present different menu items and prices, for example.

5 Claims, 7 Drawing Sheets

SIGNS AND DISPLAYS HAVING EASILY INTERCHANGEABLE INFORMATION PANELS

BACKGROUND OF THE INVENTION

The invention disclosed herein pertains to an apparatus and a method for exhibiting graphical information, including pictures of products, printed text, scenes and price information primarily for advertising products and services at the point of sale.

The use of eye-catching signs has long been recognized as an effective way to convey information in supermarkets, drug stores, department stores, and taverns, for example, to attract the attention of customers to selected goods and services. Typically, the signs are placed in a strategic location to be seen by as many persons as possible, and their effectiveness can often be increased by making active or moving displays which will more readily attract attention. Presently available display apparatus types are disadvantageous in that they are capable of exhibiting only a very limited number of pictures. An even greater disadvantage is that information displayed at the point of sale for advertising purposes is presented in sign apparatus which is not designed for convenient substitution of information panels. This is a disadvantage because the information displayed by the sign in connection with merchandising is often seasonal and in other cases the information may pertain to a community event which is transitory and anachronistic after the event.

The sign apparatus and method disclosed herein provides for quick and easy interchangability of the graphical information panels comprising the sign.

The invention disclosed herein overcomes the problems encountered in preexisting signs.

SUMMARY OF THE INVENTION

According to the invention, a device for displaying a sequence of film panels containing graphical information is characterized by a base member on which rollers are mounted for being driven rotationally about parallel axes by individual electric motors. A web comprised of a detachably interconnected series of film transparencies or panels is wound on a roller and has its opposite ends connected to opposite rollers. When one motor is energized, the roller which that motor rotates acts as a web winding or take-up roller while the other roller acts as an unwind roller. During operation of the device, the web is preferably transilluminated to permit the graphics on the individual film panels to be viewed through a window in a housing that encloses the base. That which has been thus far stated in this summary is mostly conventional.

Distinguishing features of the new design are: The manner in which the film panels are detachably interconnected, the ease with which film panels can be exchanged in a preexisting web, the ease with which an entire web can be exchanged when updating of the graphical information is appropriate, and the ease of removing an anachronistic web and installing a new one. According to the invention, the film panels are attachedly connected to form a series of panels or a web by having plastic detachably interlocking strips, sometimes called zipper fasteners, preferably adhesively attached, to opposite end margins of each film panel. These fasteners are well known per se and are characterized by a flexible plastic strip having parallel adjacent extruded grooves and ribs on each of an interlocking pair extended over the width of the end portion of the film panels that are to be detachably interconnected. Plastic zippers fasteners are described in many patents. One example is shown in U.S. Pat. No. 3,918,131 where there is a tape on each end portion of a zipper so that by pressing the tapes together, the rib or ribs of the tapes mutually register in the grooves of each other to interlock film panels together and thereby develop a suitably flexible easily opened and reclosed joint. The joints are unobtrusive to a person viewing the film panels or transparencies in sequence. The detachably interlocked joints are smaller or thinner than joints created by mechanical means such as pivot pins and hinges which make rolls large and lumpy when the web, comprised of transparency panels, is wound on a roller.

The panels that are connected by detachably interlocking means are not only used in dynamic or moving film displays but, also in accordance with the invention, they are used in static displays such as menu price boards in fast food restaurants. These signs or menu and price boards which are customarily used in fast food restaurants usually have the item of food being offered and its price silk screened onto a rigid plastic strip and a number of such strips are slid into tracks on a frame which is mounted to a light-box for transilluminating the strips to make the translucent information printed on them readable by customers. The strips, when used in a menu board, are arranged parallel with each other to form a menu list. Menu boards for accommodating the strips are rather expensive. In accordance with the invention, the foodstuff and price information is deposited by various means such as silk screening, photographic film techniques, lithography or other suitable means for transillumination and the strips, instead of being slid into slots or tracks, are connected by means of the detachable connectors alluded to in the description of the dynamic machine set forth above.

The apparatus not only provides for easy interchange of film panels in both dynamic and static display devices, but it also provides for convenient exchange of webs in their entireties.

How the foregoing and other features of the invention are implemented will appear in the ensuing more detailed description of a preferred embodiment of the invention which will now be set forth in reference to the drawings.

DESCRIPTION OF A PREFERRED EMBODIMENT

Figure 1:
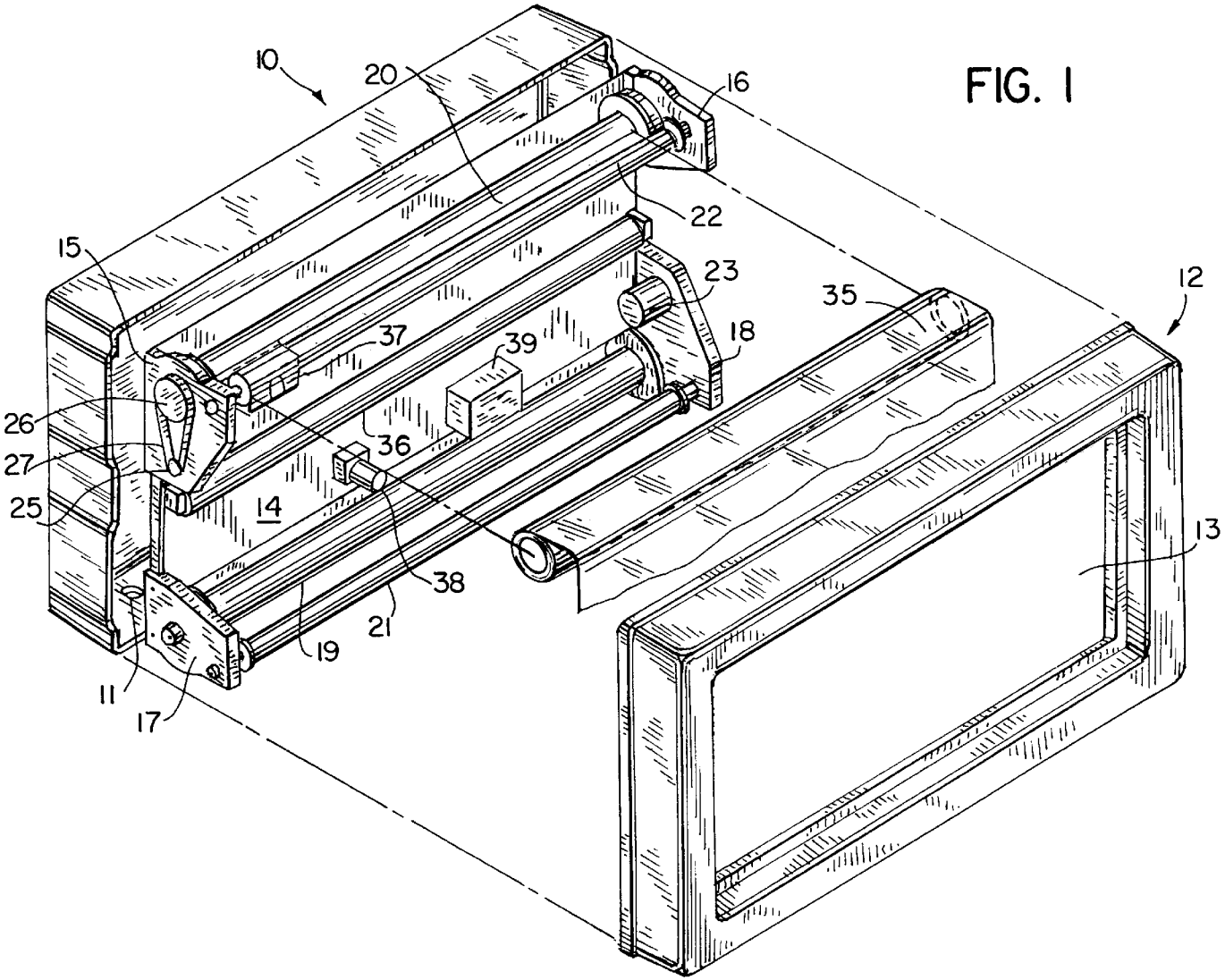
FIG. 1 is an exploded perspective view of a device for facilitating viewing a sequence of film panel transparencies.

FIG. 1 shows the new viewing device with the housing opened to display its contents. FIG. 1 affords an opportunity to identify the major components of the display system. The back section of the housing is identified generally by the numeral 10. One wall of the back portion has a hole 11 for accommodating a control switch. Another hole, not visible in FIG. 1 is provided for connecting an electrical power infeed cord to the device. The front of the housing is constituted by a frame 12 in which there is a window 13 through which scenes and information presented on the film panels may be viewed. The word "Window" is used in the generic sense to cover the situation where the window is simply an opening and the situation where a transparent glass or plastic panel overlays the opening. The base on which the mechanism of the device is mounted is generally designated by the numeral 14. There are four brackets 15, 16, 17 and 18 mounted to the corners of base 14. Diagonally positioned brackets 16 and 17 are physically identical and the other diagonally arranged brackets 15 and 18 are physically identical. In other words, bracket 16 could be flipped over and mounted in place and in the same orientation as bracket 17 and the same is true of bracket 15 which could be turned over and used in place of bracket 18. The brackets support for rotation two rollers 19 and 20 which are mounted for rotation on the brackets. The construction of the rollers will be described in greater detail later.

Figure 3:
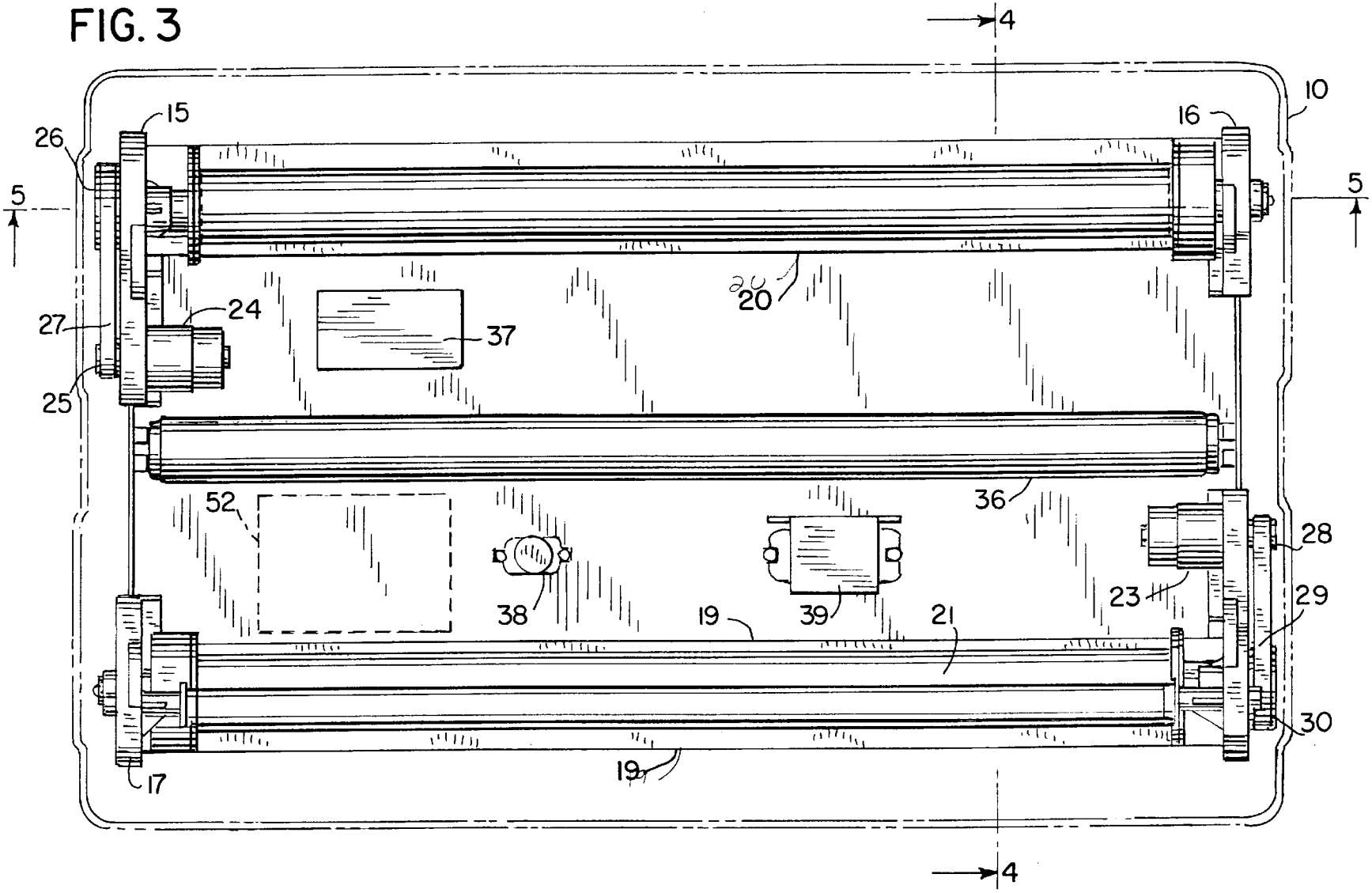
FIG. 3 is a front elevational view of the rear wall of the housing of the display device which is shown in phantom lines, and the base on which the operating components of the device are mounted.

The brackets also support a pair of idler rollers 21 and 22. Only diagonally arranged brackets 15 and 18 have an electric motor mounted to them. The motor mounted to bracket 18 is marked 23 in FIG. 1. The motor on bracket 15 is not visible in FIG. 1 but is visible in FIG. 3 where it is marked 24. In FIG. 1, the pulley on the shaft of the motor that drives film panel roller 20 is marked 25. Pulley 25 is operatively coupled to a larger pulley 26 by means of a tooth belt 27. FIG. 3 shows the corresponding pulley 28 on the shaft of motor 23 which drives roller 19 rotationally by means of belt 29 and by means of larger pulley 30 as one may see in FIG. 3. A web 35 comprised of serially and detachably interconnected film panel sheets, not visible in FIG. 1, winds and unwinds to and from rollers 19 and 20 as will be elucidated later.

The fluorescent tube 36 for back-lighting the films during viewing is also shown mounted to the base 14 in FIG. 1. A ballast for powering the fluorescent tube is mounted to the base 14 and is marked 37. The starter for the fluorescent tube is marked 38. A transformer 39 is mounted to base 14 and is used for reducing the power mains voltage to lower voltages appropriate for use in digital control circuits.

Figure 4:
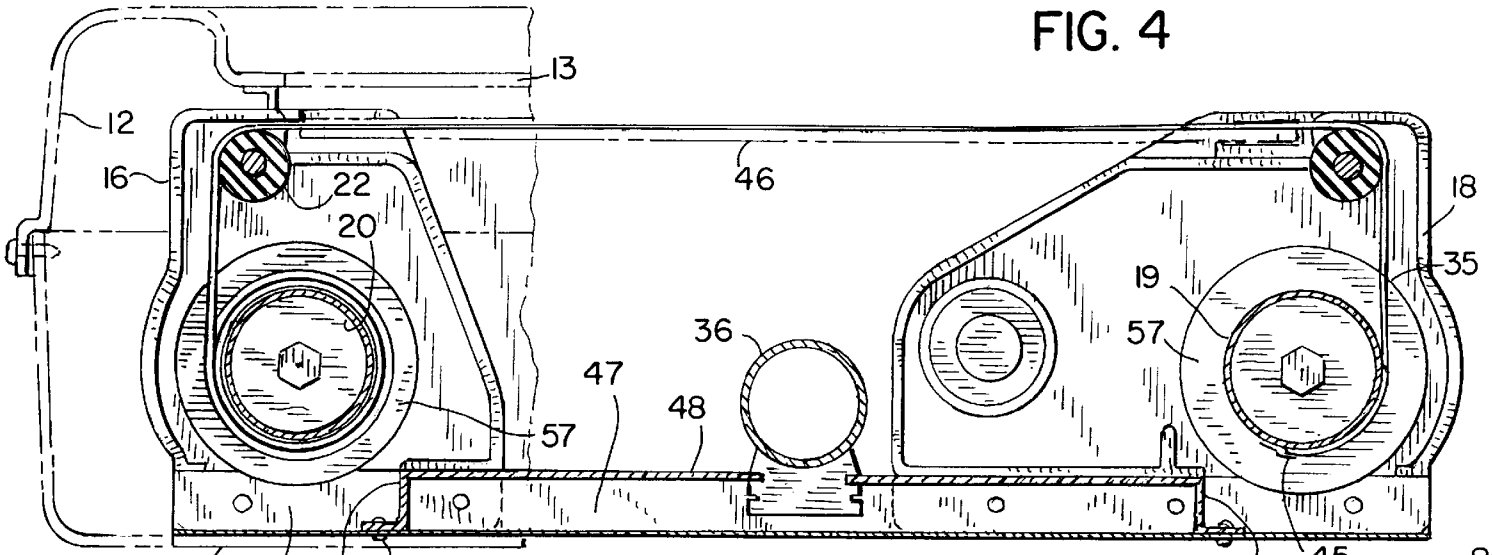
FIG. 4 is a vertical sectional view taken on a line corresponding with 4—4 in FIG. 3.

Attention is now invited to FIG. 4 which shows the manner in which the film panel web is handled in the device. This figure shows the lower cylindrical roller 19 arranged in parallel with upper roller 20. The rollers have at opposite ends retainer disks 57 for keeping the web in proper alignment as it passes from one roller to another. In FIG. 4, the film panel web 35 is attached to the roller 19 at a place that is marked 45. When the device is turned on, the motor 23 that drives roller 19 will rotate the roller in a direction that will cause the web 35 to wind onto roller 19 and to be unwound from upper roller 20. Control of the web is such that a particular scene or film panel is transported to align with the viewing window 13 where the web is stopped to permit a viewer to perceive the information which is on that particular film panel. After a time delay, the web 35 begins to move again and then stops to allow viewing of the next in the series of film panels in the web. When the entire web is unwound from roller 20, the motor driving roller 20 is energized and the motor 23 driving roller 19 is deenergized so that roller 20 becomes the winding roller and roller 19 becomes the unwind roller. The web 35 is transported over two idler rollers 21 and 22 which are positioned so as to be not visible through window 13. Idler rollers 21 and 22 keep the film panel 35 between them tense and vertical. When one motor is driving a roller to take-up or wind the web, the other motor which is coupled to the roller from which web is being unwound can be partially energized so as to effect a drag on the web which assists keeping the web in tension and unwrinkled.

The FIG. 4 embodiment shows the manner in which a transparent back-up plate 46 can be mounted behind the web for the web to slide along the surface of the plate. Base 13 has a raceway or conduit 47 overlying it. The raceway is defined by a sheet metal member 48, constituting the top of the raceway, and downwardly depending unitary side members 49 and 50. The raceway is fastened to base 14 by any suitable means such as rivets 51. Although it is not visible in FIG. 4, one may see in FIG. 3 a printed circuit board, shown in dashed lines, and identified by the numeral 52. The electronic components, not visible, are mounted on this board and are adapted to bring about the intermittent movement of the film panel web which was mentioned above. The wiring, not shown, for the various electrical components 37, 38, and 39 plus motors 23 and 24 has been omitted because the design for the electrical circuits is within the purview of an electronic circuit designer of ordinary skill.

Figure 5:
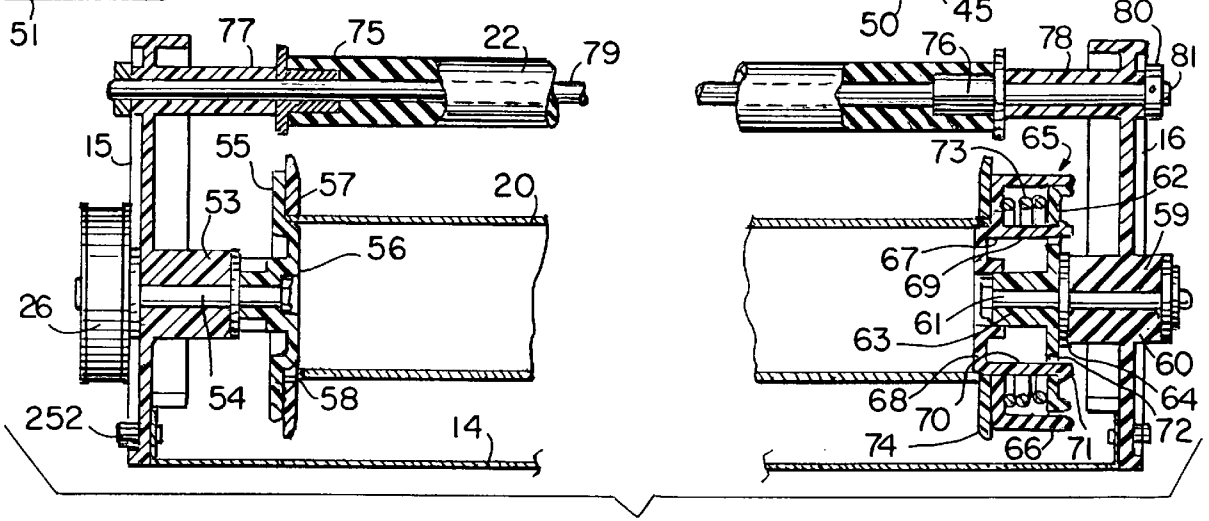
FIG. 5 shows the parts of a roller or reel on which the film web is rolled and from which is it unrolled and also showing one of the idler rollers used in the device.

FIG. 5 shows the details of one of the wind-unwind roller and idler roller, combinations. This FIGURE shows how the brackets 15 and 16 are mounted to the base 14 by means of screws such as the one marked 252. In this figure one may see that the bracket 15 is molded in one piece and includes an axially extending cylindrical portion 53 which serves as a support and a bushing for rotating shaft 54. Shaft 54 has a head on it for retaining a disk 55 which has an axial protrusion 56 for registering in a corresponding groove 58 in the side of the end disk 57 so the shaft can drive the roller. Thus, disk 55 and disk 57 are coupled in driving relationship so that roller 20 turns when pulley 26 is driven by its motor 24.

The structure at the right idler end of roller 20 is designed for making removal and insertion of roller 20 easy, according to the invention. In this case, the bracket 16 has an integrally molded cylindrical bushing member 60. A shaft 61 is journaled for rotation in bushing 60. A member comprised of a radially extending flange 62 and a hub 63 is mounted to shaft 61 for rotation with the shaft. A washer 64 separates the hub 63 from the bracket bushing 59. A collar member 65 is provided. This member 65 has a peripheral wall 66 and an end wall 67. The end wall has an axially extending cylindrical portion 68 for supporting the collar member on hub 63. Two of the four bayonet latching members or prongs 69 and 70 appear in FIG. 5 and are an integral part of collar 65. The bayonet prongs terminate in hooks such as the hook marked 71. These hooks are dimensioned to pass through four openings such as the one marked 72 in radially extending flange 62. The bayonet prongs are prestressed by molding them so that they diverge away from the axis of the collar and the hooks are beveled as evident on inspection so that they can be forced through holes 72 and then expand to lock collar 65 to radially extending flange 62. A coil spring 73 is disposed on the bayonet prongs before the collar is attached to flange 62. This is intended to be a permanent attachment. The spring reacts against flange 62 to force the collar into gripping relationship with the disk 74 that is permanently fastened to cylindrical roller 20. The collar is configured to effect a grip on roller 20, or vice versa, so that the collar serves as an idler for the right end of the roller 20 in the FIG. 5 embodiment.

If a user desires to exchange the roller 20 for another one in the FIG. 5 arrangement, the user would grip the roller 20 whether it had web wound on it or not and force it to the right so that the spring 73 compresses. This disconnects the collar 65 from the cylindrical roller 20 and disk 74 on the roller so that the left end of the roller, particularly the grooved disk 57 thereon, can be retracted away from flange 55 to enable the roller to be completely withdrawn from between the driven end and the idler end of the roller.

As shown in FIG. 5, one of the idler and web tension rollers 22 is also supported from the brackets 15 and 16. The idler rollers are preferably lightweight but strong plastic material. They have bushing inserts 75 and 76 in their ends. The brackets 15 and 16 have cylindrical extensions 77 and 78 for supporting a shaft or rod 79 on which the idler roller rotates. The ends of the rods are constrained against axially movement by the use of collars such as the one marked 80 which has a set screw 81 in it. A palnut could be used in place of collar 80 for retaining the rod 79 against axial movement.

Figure 2:
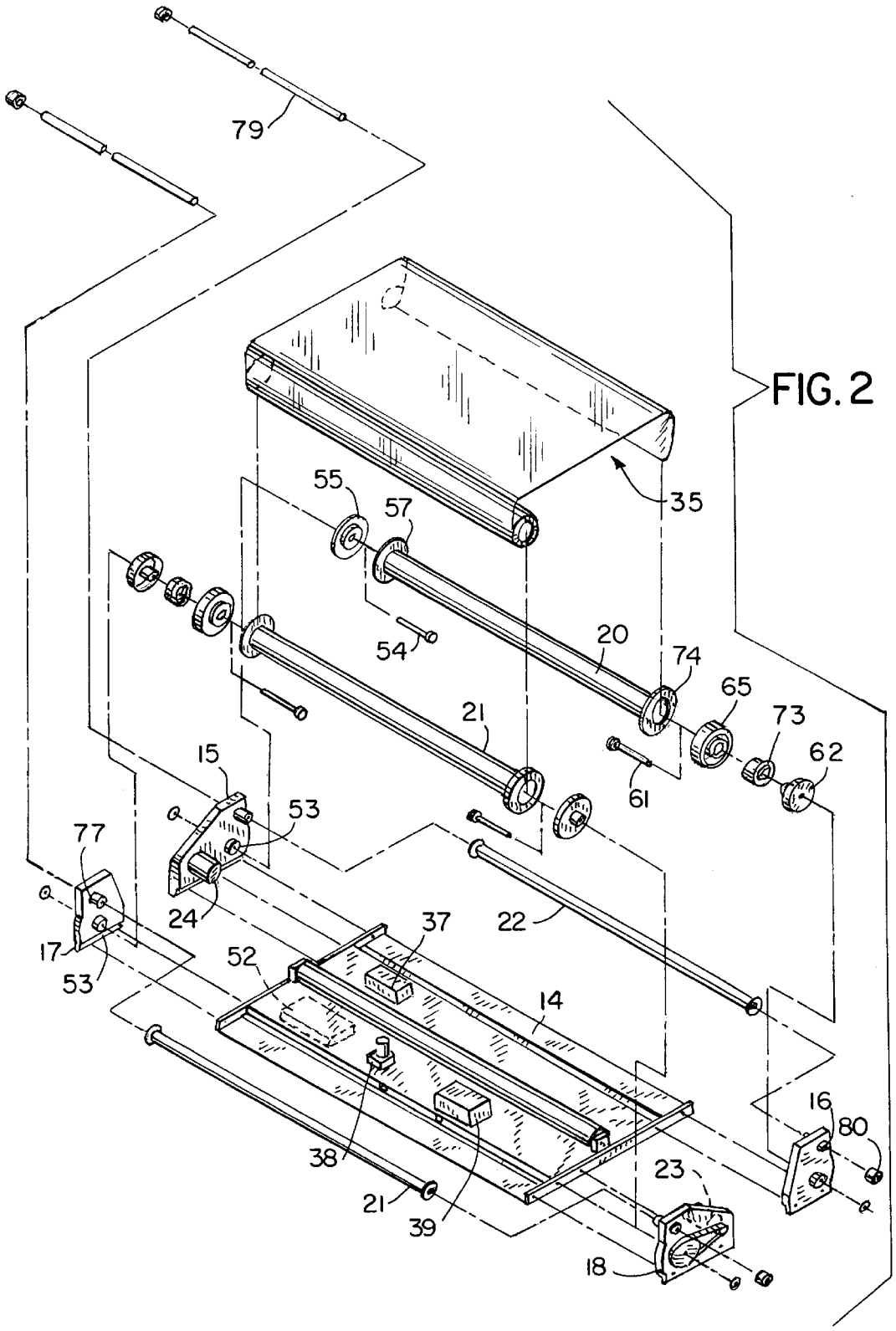
FIG. 2 is a more extensive exploded view of the components of the viewing device depicted in FIG. 1.

FIG. 2 shows the relationship of the parts of the display device. Here one may perceive the positional interchangability of the diagonally located drive end brackets 15 and 18 and the idler end brackets 16 and 17. Drive end bracket 18, is shown with its motor 23 on the far side of bracket 18 and its drive pulley, driven pulley and belt on the forefront side of the bracket. Simply turning this bracket 18 around about a vertical axis as demonstrated in FIG. 2 and transferred to the position of drive end bracket 15 changes the sides on which the components appear. The whole design is directed towards maintaining symmetry so it is not only the drive end brackets 15 and 18 that are exchangeable but the idler end brackets 16 and 17 are also interchangeable.

Figure 9:
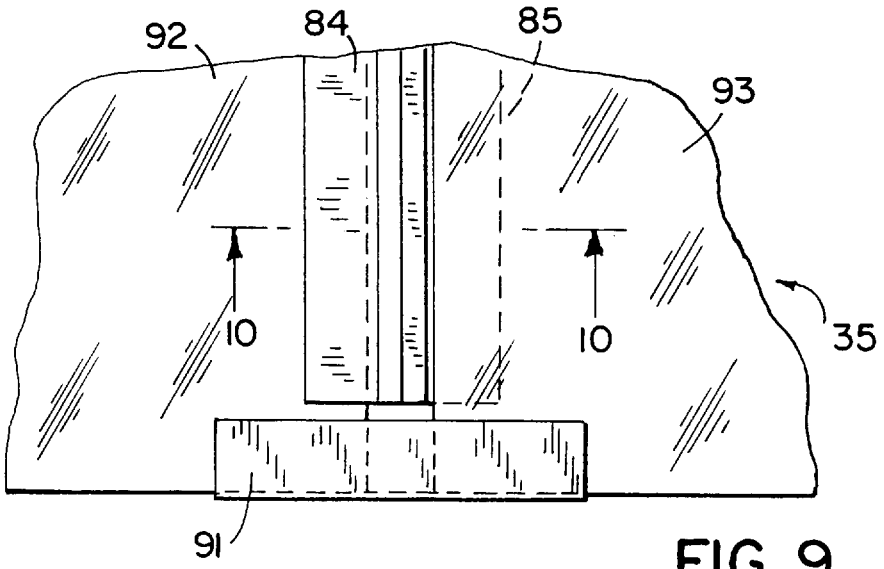
FIG. 9 is a plan view of a typical zipper interconnection between two film panels which are shown fragmentarily.
Figure 10:
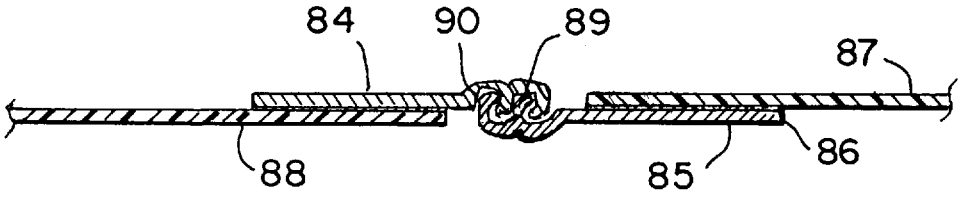
FIG. 10 is a transverse section of a connector or joint for detachably interconnecting film panels, taken on a line corresponding to 10—10 in FIG. 9.

FIG. 9 shows how two of the film panels 92 and 93 are interconnected with commercially available detachable plastic rib and groove connectors or zippers. As can be seen in FIG. 9 in conjunction with FIG. 10, the zippers are provided with flaps 84 and 85 to provide for attaching them by means of an adhesive 86 to the ends 87 and 88 of two successive film panels. When the ribs 89 and grooves 90 are interlocked they form a joint for the purposes of the invention. Of course, the zippers depicted in FIGS. 9 and 10 are shown as being magnified relative to their actual size. Even though the ribs and grooves are detachably interlocked, it is possible for the two opposite halves of an interlocked joint to slide laterally relative to each other which must be prohibited in a web that is being transported or, in other words, wound on and unwound from cylindrical wind and unwind rollers. FIG. 9 shows a folded over piece of self adhering tape 91 which is pressed onto opposite sides of the adjacent film panels to serve as a block against the panel shifting relative to each other.

Figure 6:
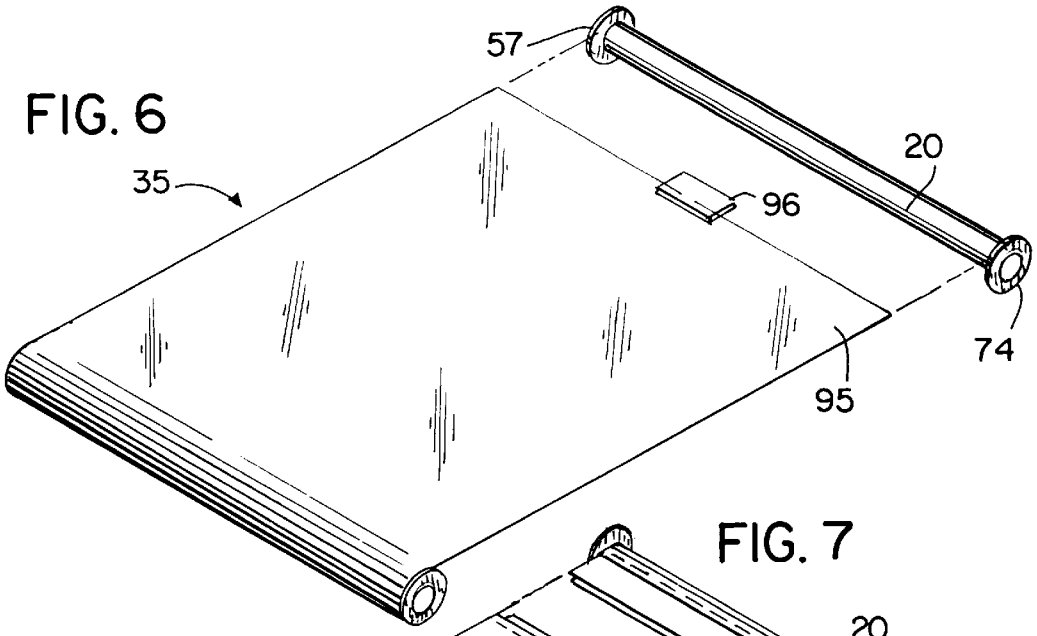
FIG. 6 shows, in perspective, two rollers on one of which a web is rolled and the other of which is there for demonstrating how to attach the end of the web to a roller by means of an adhesive strip in a case where the film panels are formed as a continuous web without joints between panels.

FIG. 6 shows a typical film panel 95 having a length that is indeterminate and depends on the choice of the designer. Each film panel has a width dimension suitable for it to fit between the end retainer disks 57 and 74 on the cylindrical rollers such as the one marked 20. In FIG. 6 the free end of the web is fastened to the roller 20 by means of a segment of pressure sensitive adhesive tape. Attaching the end of the film panel 95 to the roller 20 with a pressure sensitive tape segment 96 having an appropriate width solves a problem which otherwise arises when a majority of the width of the end of the film is rigidly fastened to roller 20. The problem with the latter is that when the film begins to wind onto the roll there is always some tendency for misalignment to occur between the film and the roller so as winding continues the film runs askew and tends to run over one of the retainer disks 57 at opposite ends of the roller. Applicant has discovered that using the adhesive tape segment 96 at the center of the film provides flexibility in the film-to-roller connection. Hence, if the film is somewhat askew relative to the roller, when the first wrap of the film on the roller is being made, the guide or retainer disks 57 can force the film 95 into perfect alignment with the roller 20. The thin pressure sensitive adhesive tape segment 96 can twist and/or stretch by a small amount to make this skew compensation possible. After the first wrap of the film on the roller is completed, the tape segment has done its work and friction resulting from the film overlapping itself maintains the alignment between the film and roller.

The width of the adhesive tape segment 96 should always be a minor percentage of width of the film 95 or the width of the roller between retainer disks 57. The width of the tape 96 should not exceed 25% of the film width but a narrower tape 96 down to about 6% of the film width is far better. In an actual embodiment of the display device wherein the film width is 26 inches (660 mm) an adhesive tape segment 96 having a width of about 2 inches (51 mm) performed as it should. In this case the strip width is 8%. of the film width. It is expected that an adhesive strip 96 having a width of 2 inches (51 mm) would be satisfactory for film having a width of up to 40 inches (1,016 mm).

The use of a segment of adhesive tape 96 in preference to other means for attaching the film 95 end to a roller 20 is advantageous from the point of view of a user of the display device where the user obtains a custom made film web from a supplier for the user to install in the display device as a replacement for a film that has become anachronistic. It is only necessary to detach the old film from the rollers and have someone endowed with minimal dexterity place the adhesive strip 96 at one end of the film to a roller at the center of the roller and then run the film to expose its opposite free end for permitting fastening this end off the film to a roller.

Figure 7:
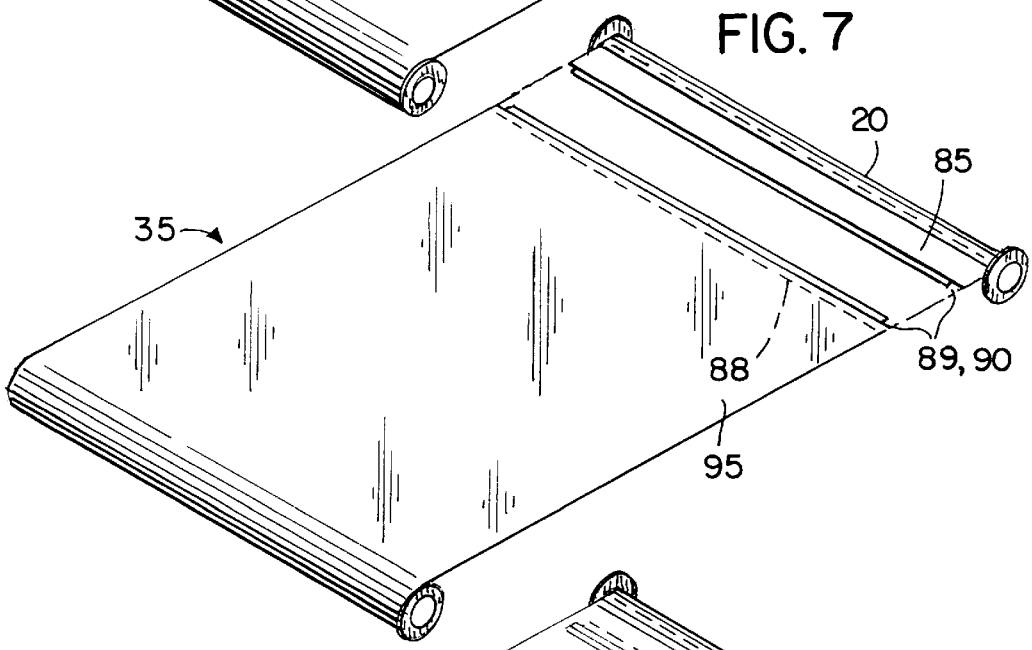
FIG. 7 shows a web composed of film panels connected together by means of plastic zippers where the end panel has one half of a rib and groove connector zipper and a stub flap having the other mating or interlocking half of a zipper connector attached to a roller to provide for the halves of the zippers to be interconnected for having the web attached to opposite rolls.

In the FIG. 7 embodiment, a flap 85 constituting one half of a detachable rib and groove joint is attached to a typical roller 20 by suitable means. The flap 85 is provided at its free edge with one half of a joint comprised of the rib 89 and groove 90 combination that enables interlocking with the corresponding mating ribs 89 and grooves 90 at the edge of the film panel 95 of web 35. A flap 88, demarked by dashed lines, is fastened to the edge of film panel. It is this flap that has the ribs for the panel.

Figure 8:
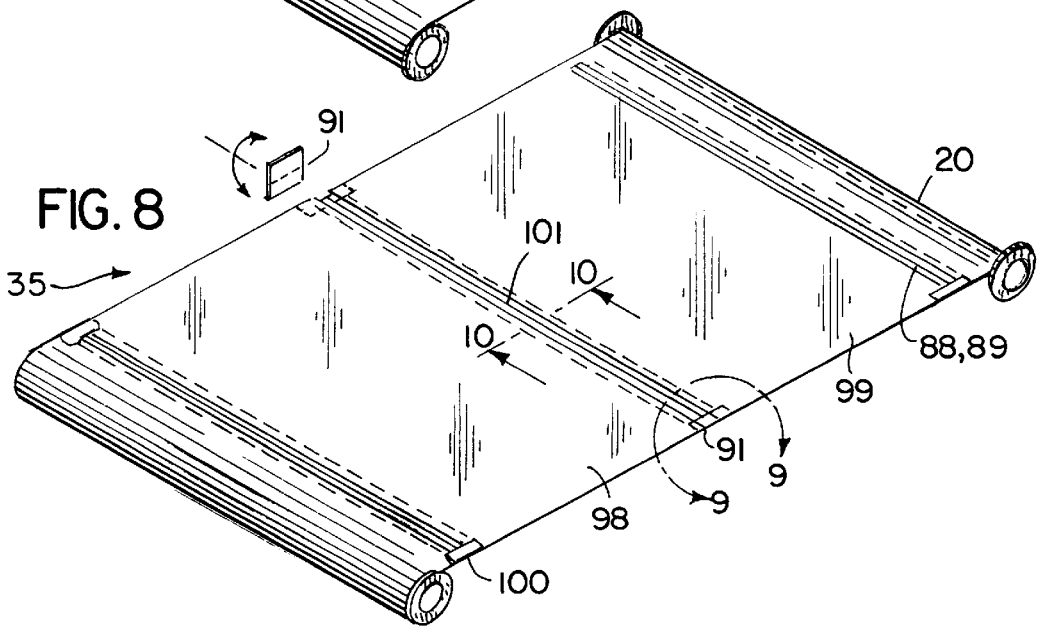
FIG. 8 shows a web comprised of a plurality of film panels which are interconnected by means of plastic rib and groove zippers where the ends of the zippers are overlaid with an adhesive tab to prevent one panel from shifting laterally relative to the panel to which it is interconnected.

FIG. 8 shows a typical embodiment of a film panel web 35 comprised of a series of panels 98 and 99 which are joined together by strips marked 100, 101 and 89,90 for the sake of being consistent with preceding FIG. 7. The retainer strips of self adhering tape 91 that are shown on one side as being fully applied and on the other side as in a state wherein the tape is not yet folded for being applied to the side edges of the panels coincident with a joint in the detachably interconnected film panels.

Figure 12:
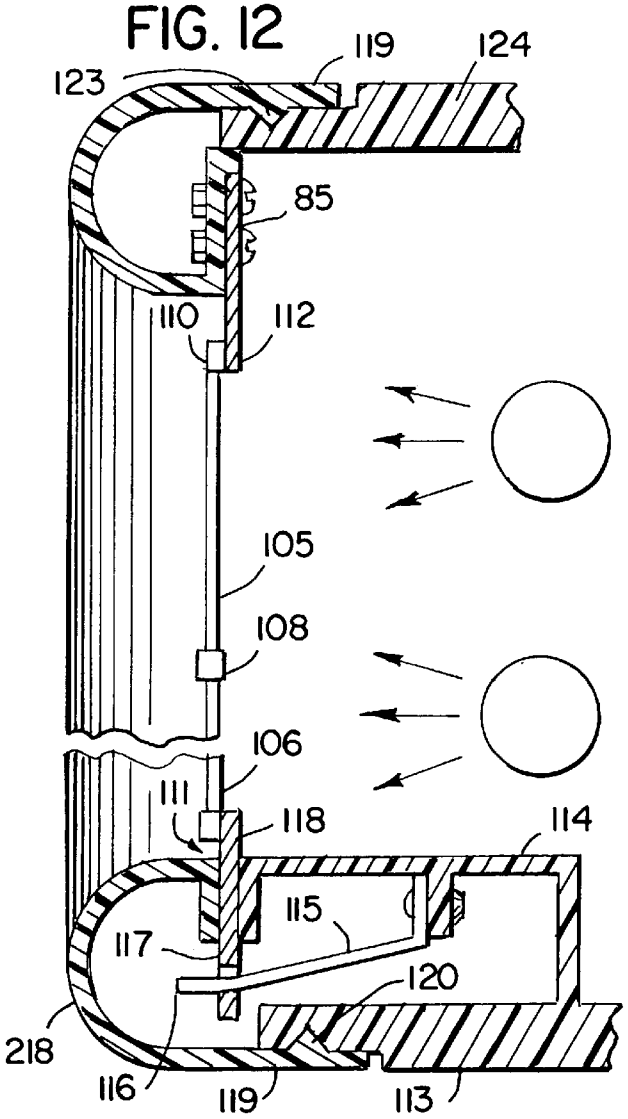
FIG. 12 is a vertical section taken on a line corresponding with 12—12 in FIG. 11.
Figure 11:
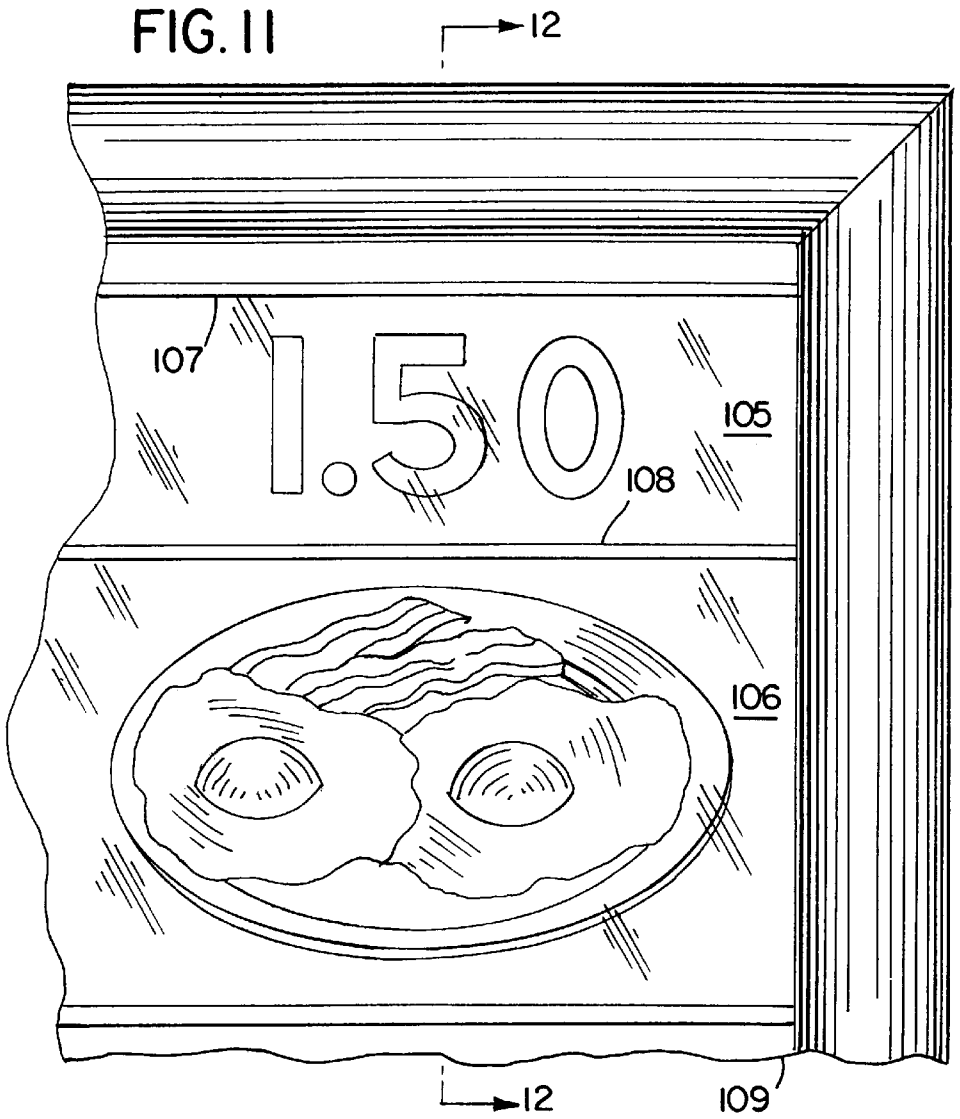
FIG. 11 is a fragmentary view of a menu board wherein film panels that are interconnected by means of rib and groove zippers are utilized.

The discussion above is related to implementation of the inventive concepts in a sign or display device that presents different scenes or graphical matter on film panels in sequence. FIGS. 11 and 12, on the other hand, illustrate one application of interlocked film panels in a static sign or display device. In particular, the panels which are interconnected by means of groove and rib connectors are used in a menu board such as is used in a fast food restaurant. Here a plurality of panels, such as the two being exhibited and marked 105 and 106, are used for presenting food item and price information. The panels are interconnected by means of connector strips marked 107, 108 and 109. Of course, in an actual menu board, there may be a dozen or more of the film panels of varying widths. The length of the panels when used in a sign board are preferably modular. That is, the length of a panel as defined by the distance between joints on successive panels, such as joints 107 and 108, and all other of the film panels have lengths which are integer multiples of a basic modular panel such as the one, 105, with the least length. FIG. 12 exhibits a series of interconnected static panels, such as 105, stretched between anchored end points 110 and 111. Endpoint 110 is on a fixed strip 112 and point 11 is on a slider strip 118. In this case, the one half zipper 85 with one half 89, 90 of the ribs and grooves on it is clamped behind a plate 12. To keep the series of film panels flat and unwrinkled, by way of tensioning the panels, the sign is provided with a frame 113 on which a member 114 is formed. A flat spring 115 has its distal end 116 extending through a hole 117 in a slider strip 118. The slider strip 118 is actually comparable to the flat 85 in FIG. 7 except that the flat is perforated at 117 to accommodate the distal ends of one or more, preferably, springs 115. The frame for the sign has a substantially semicircular cross section. The bottom region of FIG. 12 shows that the semicircular front of the frame 218 has a tongue 119 provided with a prong 120 which latches into a correspondingly shaped groove to secure the front frame of the sign to the base 113. The upper region of the sign is similar in that the tongue 119 of the frame has a prong 123 which latches to the top 124 of the sign housing.

Although embodiments of the invention have been described in detail, such description is intended to be illustrative rather than limiting, for the invention may be variously embodied and is to be limited only by construing the claims which follow.

We claim:

1. A sign providing for visualizing graphical information, comprising:

a plurality of flexible light transmissive film panels on which said information is applied, each said panel having side margins and end margins and having width defined between opposite side margins and length defined between end margins, zipper elements, each having ribs and grooves, fastened, respectively, to said end margins of said panels respectively, to provide for said ribs and grooves of a zipper element at the end margin of each said panel to mutually interlock with the ribs and grooves of a zipper element at the end margin of another of said panels to develop a hinge joint and interconnect each said panel serially to form a continuous web having opposite web ends, a pair of members spaced apart by a distance corresponding to about the length of at least one said panel, means for fastening one of said web ends to one of said members and the other of said web ends to the other of said members, and pieces of flexible tape each of which has a surface area coated with pressure sensitive adhesive, said pieces being folded with one part of the adhesive coated area of said adhesive coated area pressed onto an opposite side of the web coincident with where the zipper element of said one of said film panels is interlocked with a said zipper element on another of said film panels to prevent said zipper elements and said panels to which the zipper elements are fastened from shifting relative to each other.

2. A sign according to claim 1 wherein said means for fastening said one of said web ends to one of said members in said pair of members comprises:

a strip of material having opposite edges, one of the edges is fastened to one of said members of said pair of members and the other of the edges has a said zipper element fastened to it to provide for a said zipper element on one of said plurality of film panels to interlock with a said zipper element on said strip of material.

3. A sign according to claim 1 including:

a housing containing a window having length and width, said web is comprised of a plurality of said light transmissive film panels interlocked in series and supported in said housing for viewing at said window, said flexible light transmissive film panels are modular in that said length of one of said flexible light transmissive film panels in said web is predetermined and the lengths of other of said film panels comprising said web are a mixture of film panels that are equal in length to or are integer multiples of said predetermined length of said one film panel.

4. A sign providing for viewing graphical information on flexible light transmissive film panels connected together to form a web, comprising:

a housing having a window for viewing said panels as the panels are transported past said window, a base member mounted in said housing and spaced from said window, first and second pairs of brackets mounted to said base member, one bracket in each pair being spaced laterally of the other bracket in the same pair, one bracket in each said pair of brackets having bearing means supporting for rotation a driven shaft and the other bracket in the same pair as said one bracket having bearing means supporting an idler shaft, the axes of said driven and said idler shaft in each bracket in each pair of brackets are coaxial and the axes of the shafts in one pair of brackets are parallel to and spaced from the axes of the shafts in the other pair of brackets, a reversible electric motor mounted to one of said brackets in each pair of said pairs of brackets and means operatively coupling said motor to said driven shaft in the bracket on which said motor is mounted, a pair of rollers for winding and unwinding said web, each roller of the pair having opposite ends, with one roller of the pair adapted for being supported coaxiallv with and between one of said driven shaft and a cooperating said idler shaft, and coupling means on each of said idler shafts adapted for releasably coupling the respective idler shaft to an end of a said web unwinding and winding roller other than the end at which said driven shaft and said roller are coupled, a continuous web comprised of a plurality of light transmissive film panels on which said information is applied, each panel having side margins and end margins and having width defined between opposite side margins and length defined between opposite end margins, a zipper element fastened to each of said end margins of said panels to provide for a zipper element at the end margin of a said panel to interlock with said zipper element at said end margin of a next adjacent panel to form a hinge joint and to connect said panels serially to form said continuous web and thereby provide opposite web ends, and means for fastening said opposite web ends to said rollers, respectively, said means for coupling said motor to said driven shaft in one of the brackets in a pair to said roller comprises a drive member fixed to said driven shaft and a drivable disk member fixed to one of said opposite ends of said roller, and said drive and drivable disk members have means for releasably engaging each other when said shaft and roller are coaxial, said drive member is a disk and said drivable member is an annular member fixed on said one of said opposite ends of a said web winding and unwinding roller and one of said members has a projection and the other of said members has a recess in which said projection resisters for the roller to be driven by the driven shaft.

5. A sign according to claim 4 wherein a device for releasably coupling one of said ends of each said winding and unwinding rollers axially opposite of said drivable member to said idler shaft comprises:

a disk fastened to said one of said ends of said roller concentrically to said winding roller for retaining the web wound on the roller against shifting axially, a hub and a generally circular flange extending radially from said hub, the hub having a bore for fitting on said idler shaft that is mounted on one of said brackets in a pair without a motor, said flange having a plurality of apertures, means for retaining said hub and flange on said idler shaft, an axially slidable latching member formed as a single piece and comprised of a central radially extending disk portion having a bore for fitting on said hub, with the axes of the bore in said disk portion and the axes of said idler shaft being coaxial, radially inwardly and radially outwardly spaced apart concentric substantially cylindrical elements projecting axially in a common direction integrally from said radially extending disk portion for said cylindrical elements to define a space between them, said inner element having a plurality of axially extending bayonet hooks for entering said apertures in said circular flange on the hub to couple said latching member to said flange, and a coil spring interposed between said latching member and said flange, shifting said roller axially against said latching member to compress said spring allowing for selectively inserting and removing said roller.

* * * * *